United States Patent [19]

Nelson

[11] Patent Number: 4,989,688

[45] Date of Patent: Feb. 5, 1991

[54] ACOUSTICAL WALL PANEL AND METHOD OF ASSEMBLY

[75] Inventor: Thomas E. Nelson, Anchorage, Ky.

[73] Assignee: Soltech, Inc., Shelbyville, Ky.

[21] Appl. No.: 319,056

[22] Filed: Feb. 16, 1989

[51] Int. Cl.[5] ..... E04B 1/82

[52] U.S. Cl. ..... 181/287; 181/286; 181/291; 181/295; 181/296

[58] Field of Search ..... 181/287, 290, 291, 295, 181/296, 286

[56] References Cited

U.S. PATENT DOCUMENTS

| | | | |
|---|---|---|---|
| 2,140,210 | 12/1938 | Schenk | 181/291 |
| 2,285,423 | 6/1942 | Esser | 181/290 |
| 2,824,618 | 2/1958 | Hartsfield | 181/290 X |
| 2,911,076 | 11/1959 | Saunders et al. | 428/117 |
| 3,037,578 | 6/1962 | Jack | 181/291 |
| 3,176,789 | 4/1965 | Lighter | 181/240 |
| 3,274,046 | 9/1966 | Shannon et al. . | |
| 3,441,465 | 4/1969 | Pearson . | |
| 3,949,827 | 4/1976 | Witherspoon . | |
| 4,016,234 | 4/1977 | Warren et al. . | |
| 4,076,100 | 2/1978 | Davis | 181/290 |
| 4,167,598 | 9/1979 | Logan et al. | 181/290 X |
| 4,214,646 | 7/1980 | Planes et al. | 181/287 |
| 4,215,765 | 8/1980 | Harris | 181/287 |
| 4,237,178 | 12/1980 | Mazaki | 181/290 X |
| 4,282,276 | 8/1981 | Smith | 428/35 |
| 4,437,542 | 3/1984 | Yeager et al. | 181/290 |
| 4,487,291 | 12/1984 | Walker | 181/290 |
| 4,630,416 | 12/1986 | Lapins et al. | 181/290 X |
| 4,706,422 | 11/1987 | Ashton | 181/291 X |

*Primary Examiner*—Benjamin R. Fuller

*Attorney, Agent, or Firm*—Woodard, Emhardt, Naughton Moriarty & McNett

[57] ABSTRACT

A movable, prefabricated wall panel having a rigid frame. Internal to the rigid frame is a structural acoustical core, consisting of a grid with a plurality of individual cells, each filled with insulation media, such as a loose, discrete insulation such as fiberglass, cellulose, etc. The outer surfaces of the cell grid are covered with a skin or screen mesh for confining the loose discrete insulation. This skin or mesh can be a finished decorative outer cover or an intermediate component that is later covered with a decorative outer cover of fabric or other suitable material. A septum may be provided in the panel in the grid and may be made of a pliable, sound absorbing material. Additional acoustic barrier panels may be sandwiched on either side of the cellular grid.

25 Claims, 7 Drawing Sheets

ACOUSTICAL WALL PANEL AND METHOD OF ASSEMBLY

BACKGROUND OF THE INVENTION

The present invention relates generally to wall panels, and more specifically to acoustical wall panels, such as used as office partitions, and to methods of their fabrication.

It is desirable in many commericial and industrial offices to have a system of modular acoustical dividers that allow privacy while maintaining design flexibility and noise abatement qualities consistent with the desired work environment. To best accomplish these traits it is necessary to produce a panel that consists of a rigid frame, acoustical materials for noise abatement, and an outer decorative cover material for design aesthetics. While it is often desirable to have a soft feel to the exterior of the panel, it is also important to have rigidity across the entire expanse of panel surface so that there is not a great deal of deflection when a force is exerted against the acoustical system within the outer rigid frame. These two traits—soft feel and rigidity for low deflection—can be contradictory in the design of an acoustical system. If the outer surface is soft the inner core must be rigid. Many current panel designs employ a high density fiberglass to achieve rigidity. Others employ a rigid inner septum or barrier of chipboard, metal, wood, or particle board in combination with fiberglass. Both of these approaches are costly with the added cost associated mostly with rigidity in mind.

If either of these approaches are taken to an extreme with too high a density of fiberglass or too thick of a septum material, they can actually detract from the acoustical effectiveness of the design. Rigid materials are often good sound transmitters because they are prone to vibration. As fiberglass insulation increases in density, it becomes a poorer noise absorber of many common sound frequencies found in the office environment. Consider the following results of a standard ASTM test comparing a 3#/cu. ft. density with a 6#/cu. ft. density fiberglass insulation.

| Thickness | Density | Sound Absorption Values Frequency in Hz | | | | | | |
|---|---|---|---|---|---|---|---|---|
| | | 125 | 250 | 500 | 1000 | 2000 | 4000 | NRC |
| ½" | 3# | .10 | .39 | .34 | .54 | .74 | .86 | .50 |
| ½" | 6# | .13 | .36 | .28 | .53 | .78 | .88 | .49 |

The present invention provides an economical acoustical panel that uses a unique combination of components to achieve improved acoustical performance and to provide the rigidity required for various design specifications. At the same time it can accommodate a range of exterior textures while not compromising acoustical performances or rigidity.

The present invention has a rigid frame of steel, plastic, wood, or other suitable material and has an inner acoustical core with a divider grid defining multiple cells. The core construction has each cell filled with a suitable insulation material such as fiberglass batting or loose, discrete insulation material. A confinement layer may be fastened (stapled, heat sealed, glued) to each surface of the cellular grid to retain the insulation material in the cells. This layering may be a wire screen mesh, plastic mesh, plastic film, cloth, etc. Other features are described in greater detail below.

The present invention provides several significant advantages. The compartmentalized cellular grid is designed to provide the required rigidity. Because the grid comprises mostly open space with each divider grid wall having a minimum of cross-sectional area, it is not as prone to vibrating as is a large, rigid, planar surface when exposed to sound energy. Also, because of the strength provided by this type of geometry, a thin material such as chipboard or other heavy weight paper products can provide rigidity even though these materials are not particularly rigid when a single layer is used in a planar fashion across a frame.

Because of the large percentage of openness in the cellular grid arrangement, the optimum acoustical insulation material may be present in the largest percentage of the panel interior. This material can be chosen for the desired cost/performance combination required regardless of its density or rigidity characteristics.

An additional advantage of this invention is that with the rigidity issue resolved, an intermediate acoustical septum can be located within the core if further noise reduction is desired. This barrier can be of a pliable or viscoelastic nature to abate noise transmission as opposed to a more rigid vibrating member as is used in many existing panel designs.

SUMMARY OF THE INVENTION

The present invention provides a movable prefabricated acoustical wall panel, comprising: a rigid frame defining a frame perimeter around a partition area; an acoustical core located in the partition area and supported by the frame, the acoustical core having a front side and a back side and comprising: a divider grid formed by a network of interesting divider walls, the divider walls defining a plurality of individual cells across the partition area, wherein the intersecting divider walls run between the front and back sides of the acoustical core so that the cells are open along the front and back sides of the acoustical core; solid, low density insulation media in the cells across the partition area; a first confinement layer across the divider grid on the first side of the acoustical core to confine the insulation media in the plurality of cells; and a second confinement layer across the divider grid on the second side of the acoustical core to confine the insulation media in the plurality of cells.

The present invention further provides a movable prefabricated acoustical wall panel, comprising: a rigid frame defining a frame perimeter around a partition area; an acoustical core located in the partition area and supported by the frame, the acoustical core having a front side and a back side and comprising: means for holding insulation media across the partition area between the front and back sides of the acoustical core; solid, low density insulation media in the cells across the patition area; a first confinement layer across the divider grid on the first side of the acoustical core to confine the insulation media in the plurality of cells; a second confinement layer across the divider grid on the second side of the acoustical core to confine the insulation media in the plurality of cells; and a substantially planar septum across the partition area and disposed between and generally parallel to the first confinement layer and the second confinement layer, the insulation media being located both between the septum and the first confinement layer and between the septum and the second confinement layer, wherein the septum is made of a pliable, flexible, nonrigid sheet material.

The present invention further provides a method or prefabricating a movable acoustical wall panel, comprising the steps of: providing a rigid frame defining a frame perimeter around a partition area and defining a front side and a back side; mounting a preformed rigid divider grid in the partition area in the frame, the divider grid being formed by a network of intersecting divider walls, the divider walls defining a plurality of individual cells across the partition area, wherein the intersecting divider walls are positioned in the mounting step to run between the front and back sides of the acoustical core so that the cells are open along the front and back sides; securing a first confinement layer across the divider grid on the first side to provide confinement for insulation media in the plurality of cells; inserting solid, low density insulation media in the cells across the partition area; and securing a second confinement layer across the divider grid on the second side to confine the insulation media in the plurality of cells.

One object of the present invention is to provide an improved acoustic wall panel.

Another object of the present invention is to provide an improved method of fabrication of an acoustic wall panel.

Another object of the present invention is to provide an economical acoustical panel to be used in modular acoustical office divider systems.

These and other objects will be apparent from the following description of the preferred embodiment.

2E is a partial front side elevational view of an alternative embodiment of the present invention.

Figure 3A:
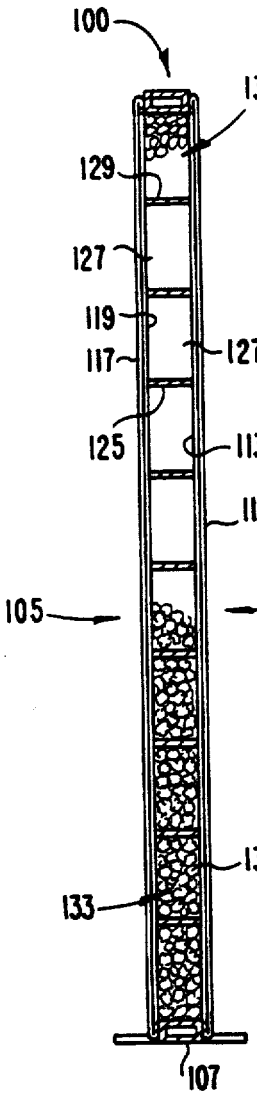
Figure 2A:
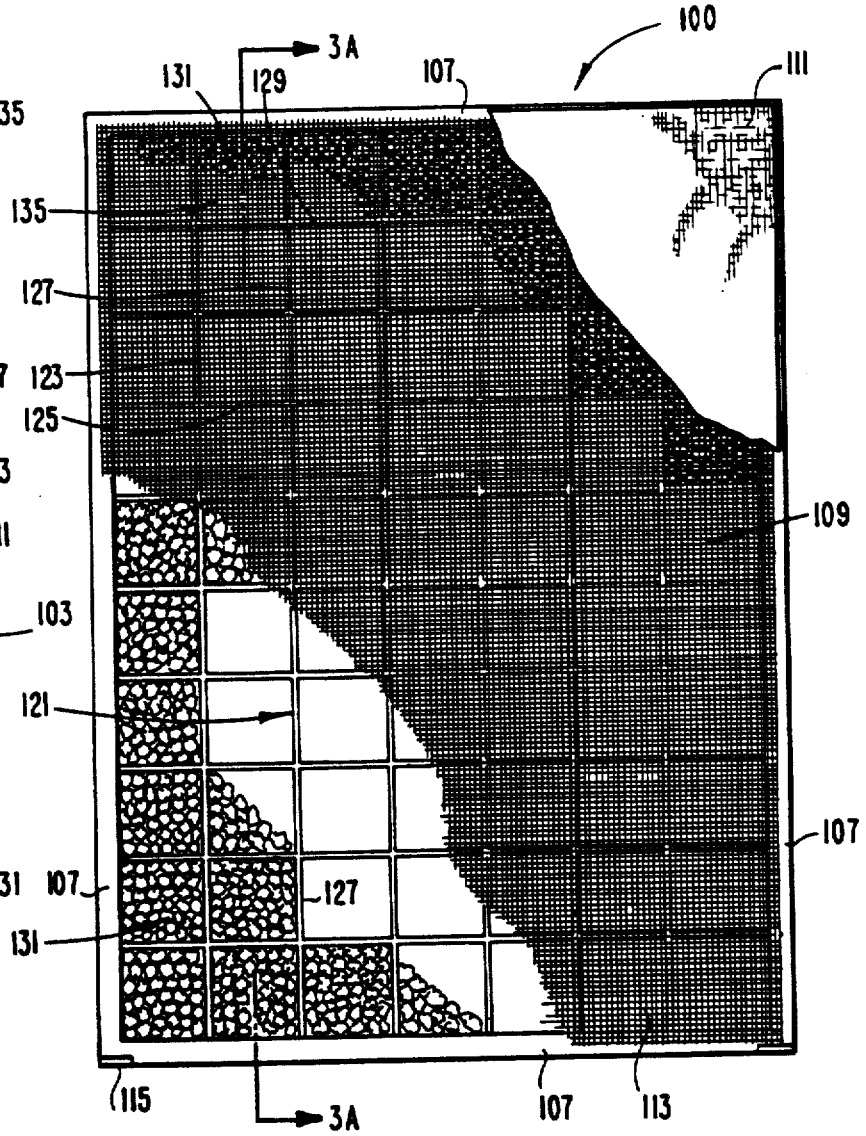
FIG. 2A is a front side elevational view, partially cut away, of one of the wall panels illustrated in FIG. 1.

FIG. 3A is a cross-sectional end view of the first embodiment of the present invention taken along line 3A—3A in FIG. 2A.

Figure 3B:
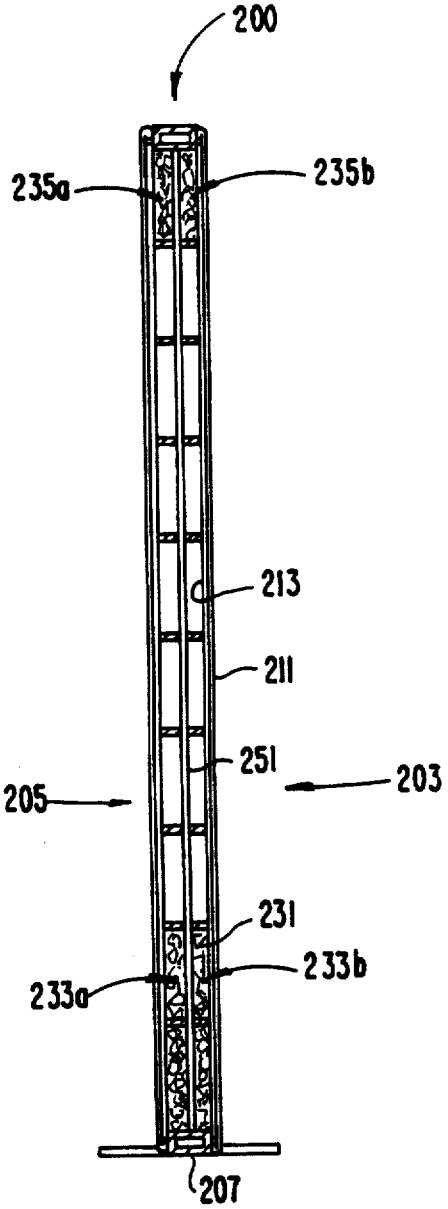

FIG. 3B is a cross-sectional end view of an alternative embodiment of the present invention.

Figure 3C:
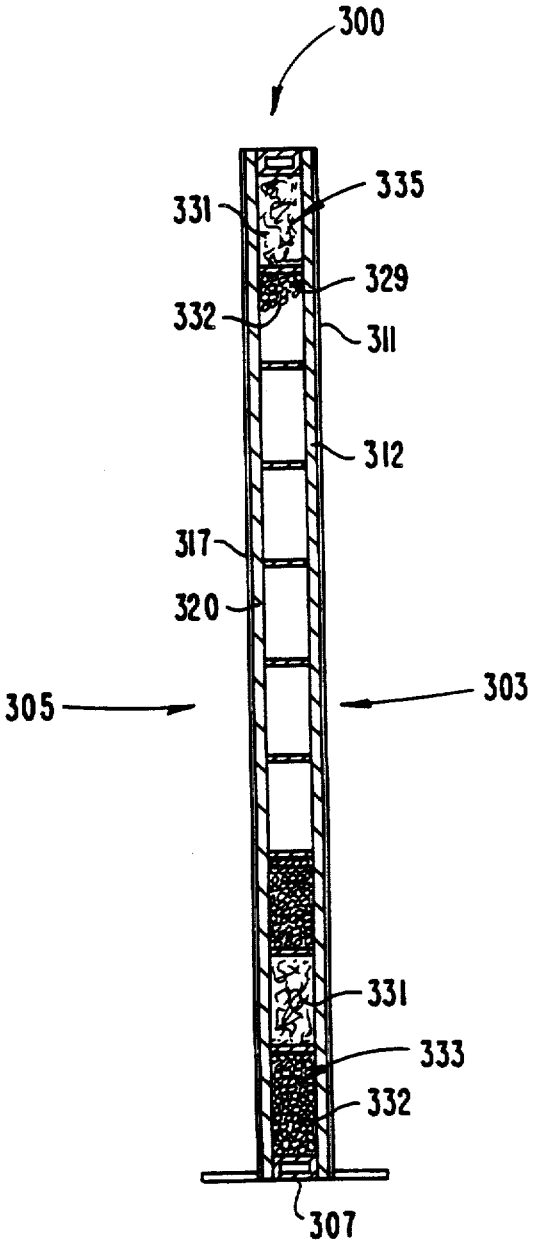

FIG. 3C is a cross-sectional end view of an alternative embodiment of the present invention.

Figure 4A:
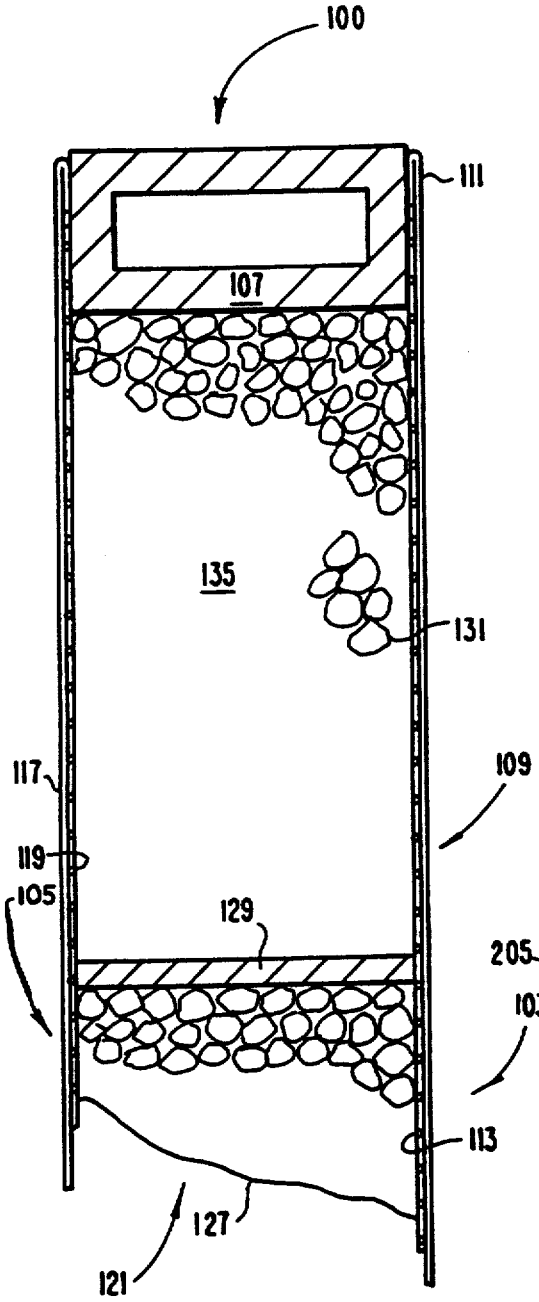

FIG. 4A is an enlarged detail view of the top end of FIG. 3A.

Figure 4B:
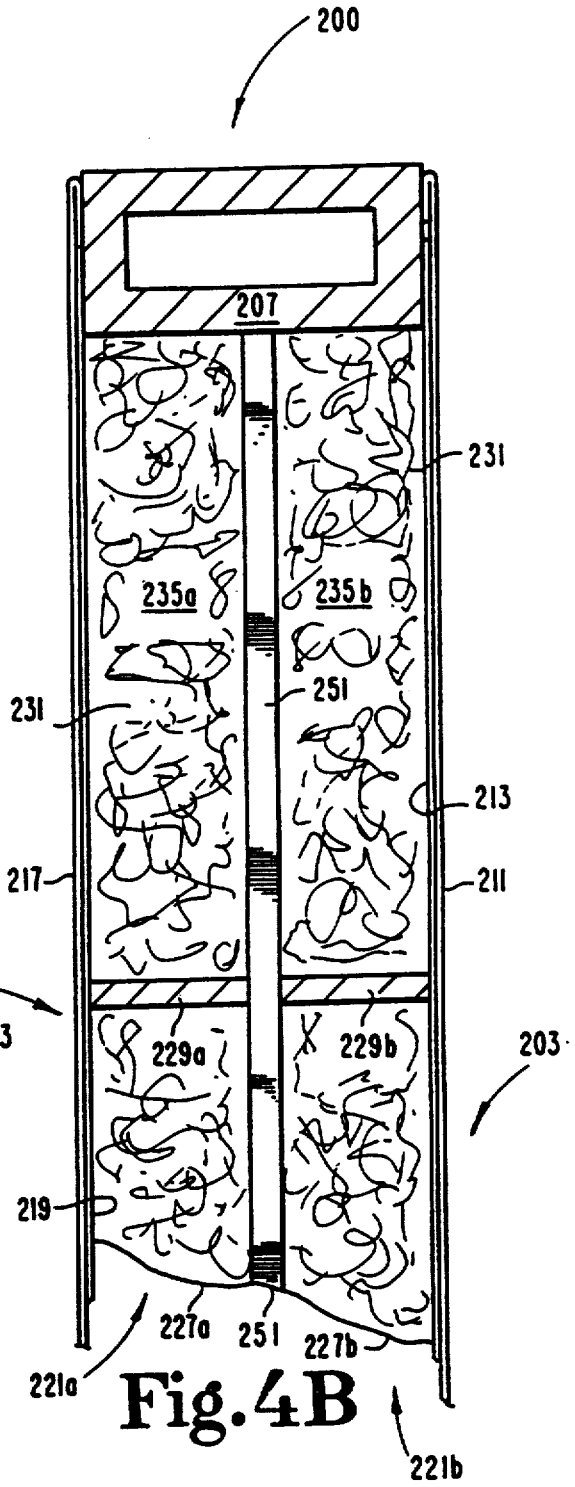

FIG. 4B is an enlarged detail view of the top end of FIG. 3B.

Figure 4C:
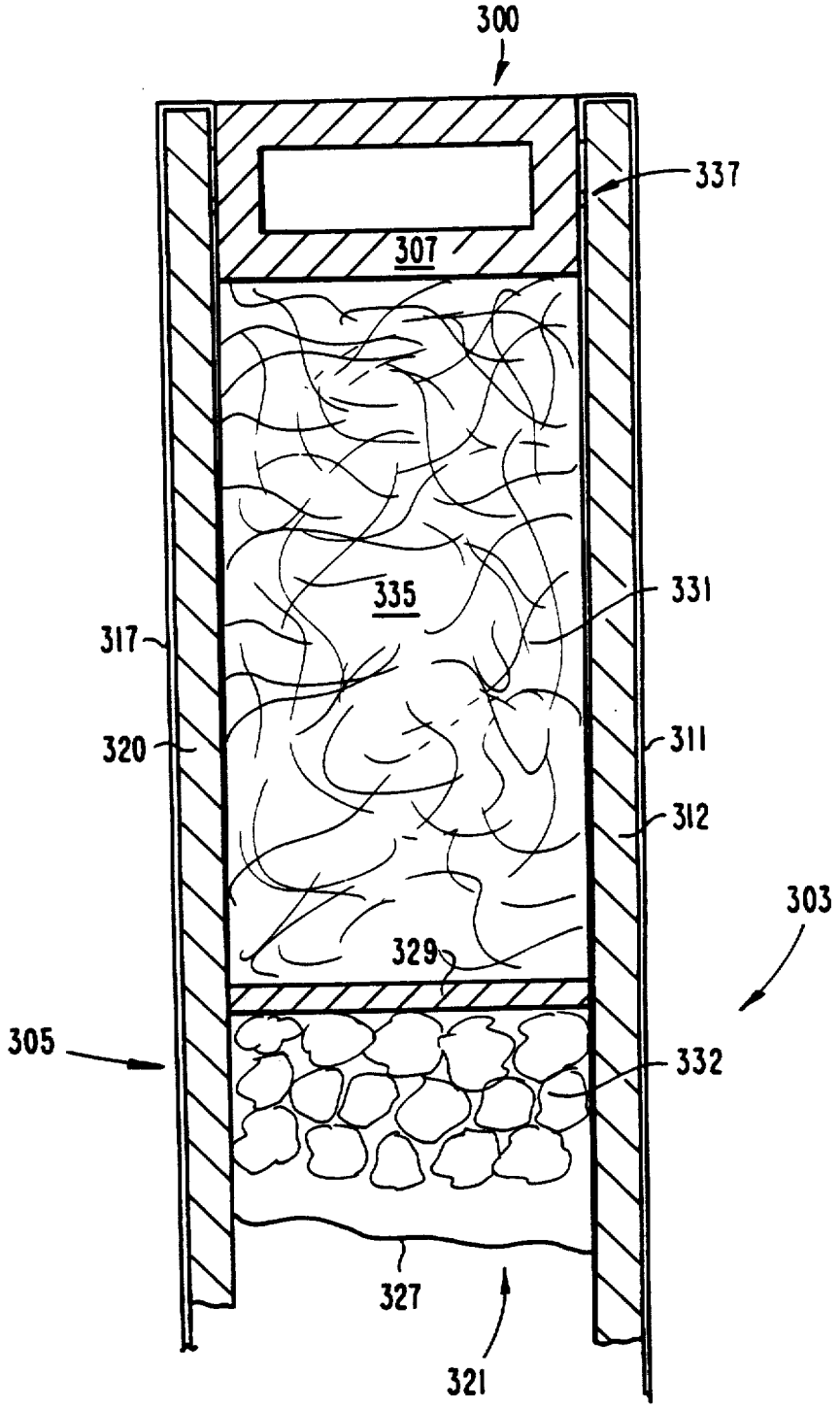

FIG. 4C is an enlarged detail view of the top end of FIG. 3C.

Figure 1:
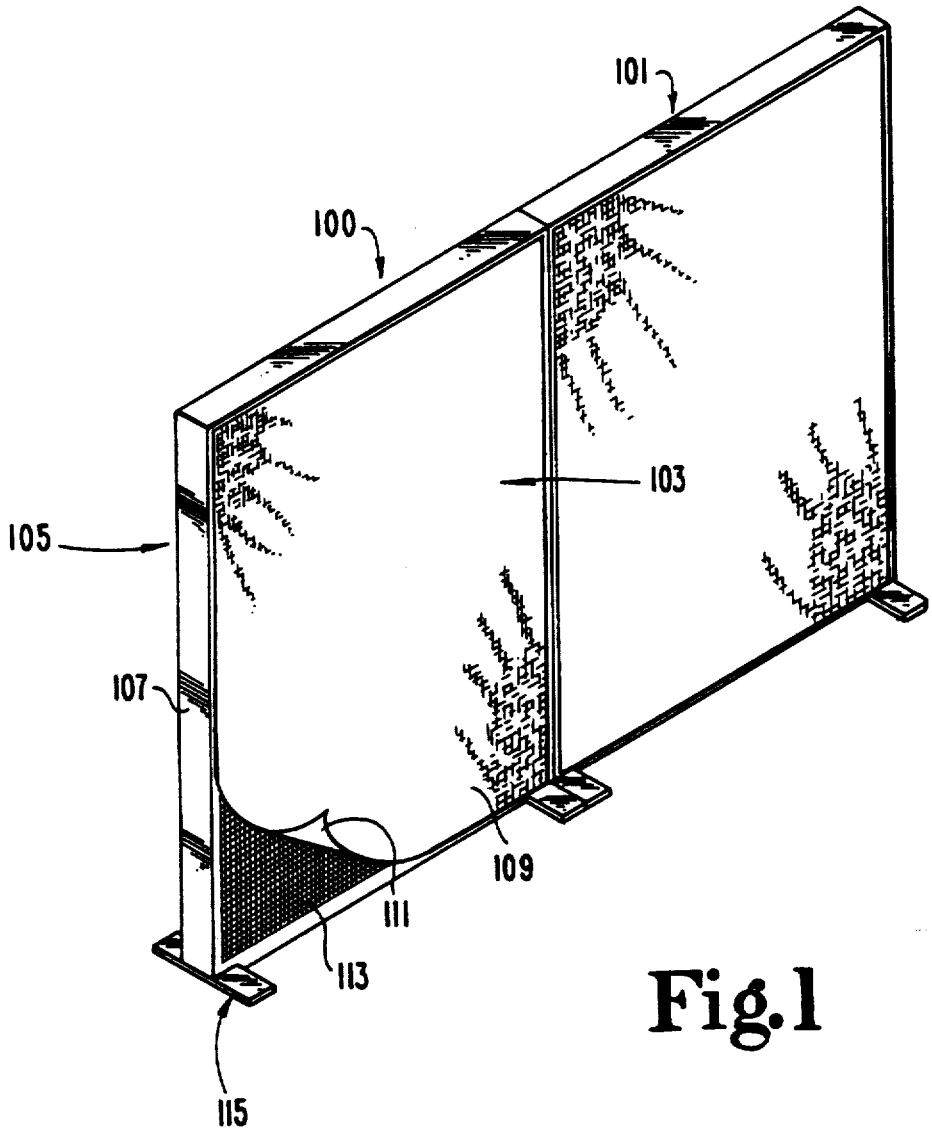
FIG. 1 is a perspective view of a first embodiment of a pair of wall panels according to the present invention.
Figure 5:
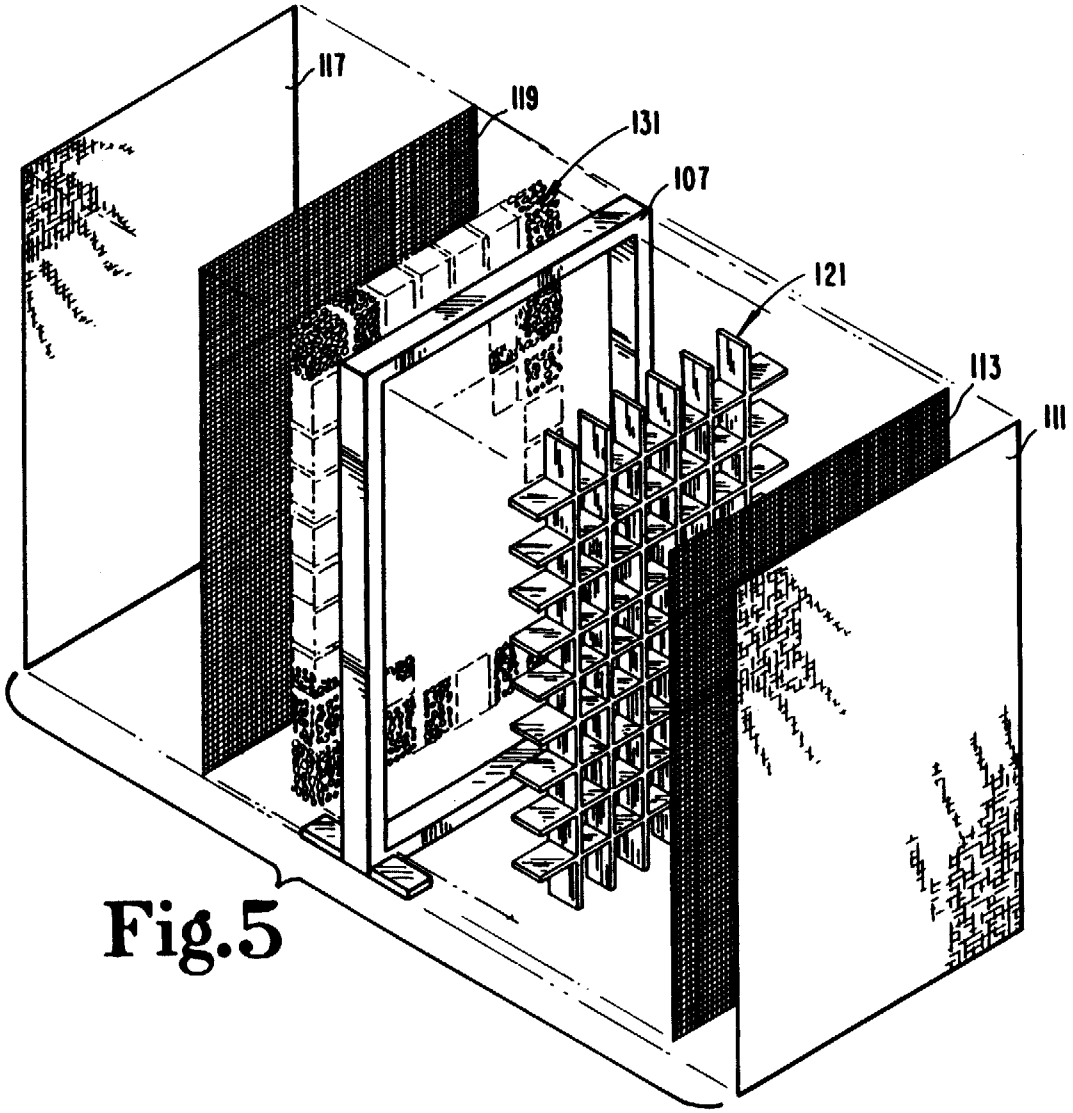

FIG. 5 is an exploded perspective view of one of the wall panels illustrated in FIG. 1.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device and method, and such further applications of the principles of the invention as illustrated therein being contemplated as would normally occur to one skilled in the art to which the invention relates.

FIGS. 1-5 illustrate five various embodiments of the present invention with like reference characters denoting like elements. Elements in the five illustrated embodiments are identified by a corresponding number in the hundreds digit. Accordingly, there is a "100" series, a "200" series, a "300" series, a "400" series, and a "500" series corresponding to the five embodiments.

Referring to FIGS. 1, 2A, 3A, 4A and 5, wall panel 100 and its component parts are illustrated. FIG. 1 illustrates a like wall panel 101 adjacent to wall panel 100, forming a modular construction of movable, prefabricated, acoustical wall panels. Wall panel 100 may be supported by feet, such as foot 115. Wall panel 100 has a front side 103 and a back side 105 opposite thereof. Rigid frame 107 is preferably rectangular with two vertical uprights, a header and a footer as illustrated. Frame 107 may be made of a variety of materials such as steel, aluminum, plastic, or wood. Frame 107 as illustrated is rectangular and defines a frame perimeter around a partition area in which acoustical core 109 is located the way a picture is located in a picture frame. Acoustical core 109 may include a decorative cover 111 fastened to frame 107 outside of confinement layer 113 and along front side 103 with decorative cover 117 (see FIGS. 3A and 4A) fastened to frame 107 along back side 105. The decorative cover may be made of cloth, vinyl or the like, preferably having a soft feel and a cosmetically attractive appearance.

Acoustical core 109 is made rigid by divider grid 121 which is formed by a network of intersecting divider walls and is mounted in the partition area defined by frame 107. Divider walls, such as vertical divider wall 123, horizontal divider wall 125, vertical divider wall 127 and horizontal divider wall 129 (see FIG. 2A), make up girl 121, defining a plurality of individual cells or compartments across the partition area. The divider walls preferably are relatively thin in cross-section but have a width which runs between front side 103 and back side 105. Such elongated cross-sectional geometry provides a relatively large cross-sectional moment of inertia, providing rigidity in divider grid 121 against planar deformation. Divider grid 121 may be made of interlapped chipboard, corrugated materials such as corrugated cardboard, plastic, or other such rigid material so that grid 121 is rigid against deflection from its generally planar shape. Divider wall 127 and divider wall 129 partially define cell 135 which is similar to the plurality of other cells, such as cell 133 across acoustical core 109. Wall panel 100, as illustrated in FIG. 2A, has seven columns of ten cells making a total of seventy cells in core 109. More or less cells may be defined according to design.

Cells, such as cell 135, when initially fabricated, are open along the front side and the back side of acoustical core 109. However, the cells are filled with a solid, low density insulation media in each cell then sealed with confinement layer 113 along the front side and with confinement layer 119 (see FIGS. 3A and 4A) along the back side. In the drawing figures, such as FIGS. 2A, 3A, 3B, 3C and 4A, the insulation media is drawn only representatively, it being understood that the actual embodiments have insulation media throughout each of the cells.

The insulation material is solid, rather than liquid or gaseous, and may be of a variety of materials, such as loose, discrete particles of insulation, batts of fiberous material, foam, in-situ foam, or the like. Insulation material 131 as illustrated in FIG. 2A is loose, discrete particles of insulation. The insulation material in this embodiment, and the other embodiments described below, may be made of material such as urethane foam, polyethylene foam, fiberglass, fiberglass/chip laminate, fiberglass/chip composite, foam/chip laminate, foam/chip composite, cellulose, and the like.

Confinement layer 113 and confinement layer 119 each may be made of a variety of materials, including a mesh screen made of plastic or metal, a plastic film, cloth, or other sheet material. Typically, it is relatively thin, and fastened to frame 107 and to grid 121 by heat sealing, glue, staples or other fasteners, or a combination thereof. Such fastening to grid 121 is along the front edges and back edges of the divider walls wherein the individual cells are sealed to contain insulation material 131. As illustrated, confinement layer 113 is a screen mesh with openings smaller than the discrete particles making up insulation 131.

Referring to FIGS. 3B and 4B, another embodiment is shown as wall panel 200. Wall panel 200 includes septum 251 located in a medical plane of the partition area defined by frame 207. Septum 251 is preferably made of a pliable, flexible, nonrigid sheet material such as vinyl, loaded vinyl, viscoelastic compounds, and the like. Alternatively, the septum may be made of chipboard, steel, wood, plastic or damped metal. When septum 251 is made of a pliable, flexible, nonrigid sheet material, it tends to have greater sound energy absorption characteristics. Septum 251 is substantially planar across the partition area and is disposed between and generally parallel to confinement layer 213 and confinement layer 219. Insulation media 231 is located both between septum 251 and confinement layer 213, such as in cell **235*b*, and between septum 251 and confinement layer 219, such as in cell 235*a*. This dual configuration of cells, cell 235*a* and cell 235*b*, is formed by sandwiching septum 251 between divider grid 221*a* and divider grid 221*b*, which are separately formed. Grid 221*a* is made up of walls such as vertical divider wall 227*a* and horizontal divider wall 229*a*. Similarly, divider grid 221*b* is made up of intersecting wall such as vertical divider wall 227*b* and horizontal divider wall 229*b*. Decorative cover 211 is fastened on front side 203, whereas decorative cover 217 is fastened on back side 205. Note that the decorative covers may have a hem along their outer edge for cosmetic appearance. FIGS. 3B and 4B illustrate a fiberous batt insulation material 231 located in the various cells such as cell 233*a*, cell 233*b*, cell 235*a*, and cell 235*b***.

Referring now to FIGS. 3C and 4C, another embodiment of the present invention is shown as wall panel 300. Wall panel 300 is similar to wall panel 100 except that wall panel 300 further includes acoustic barrier panel 312 along front side 303 and acoustic barrier panel 320 along back side 305. Typically, such acoustic barrier panels are used in lieu of confinement layer 113 and confinement layer 119, although they may be used in addition to such confinement layers. As illustrated in FIGS. 4C, the acoustic barrier panels are attached to frame 307 such as at attachment 337 which may be glue, screws, or other such fasteners. Panel 312 and panel 320 are typically made of solid, low density materials such as low density fiberglass, cellulose, urethane foam, polyethylene foam, fiberglass/chip composite, fiberglass/chip laminate, foam/chip composite, foam/chip laminate, molded fiberglass, or similar such material. These panels are typically rigid and low density to allow for absorption of acoustical energy. Any number of exterior materials can be applied to panel 312 and 320 prior to applying the respective decorative covering 311 and decorative covering 317. In this way, the present invention may achieve the required texture or other physical characteristics. For example, a low density fiberglass or foam could be applied for a soft feel prior to applying a decorative fabric. If a tackable surface (one allowing devices such as thumb tacks to be stuck into) is desired, a molded fiberglass or higher density or other suitable material may be used for panels 312 and/or panel 320.

In FIGS. 3C and 4C, insulation material 331 is shown as a fiberous batt material located in cell 335. Horizontal divider wall 329 separates insulation material 331 from insulation material 332, which is illustrated as loose, discrete particulate insulation. Wall 329 and wall 327 intersect to form divider grid 321 which is substantially similar to divider grid 121 previously described. The use of the two types of insulation, insulation 331 and insulation 332, provides the similar acoustical characteristics as further described below in conjunction with FIGS. 2B and 2C.

Figure 2C:
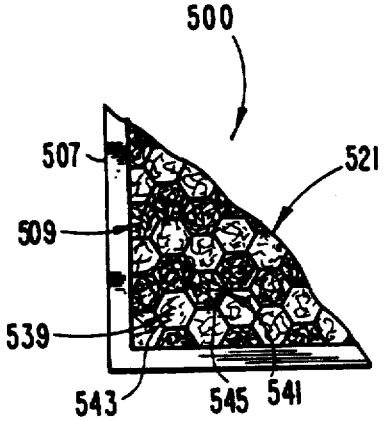
FIG. 2C is a partial front side elevational view of an alternative embodiment of the present invention.
Figure 2B:
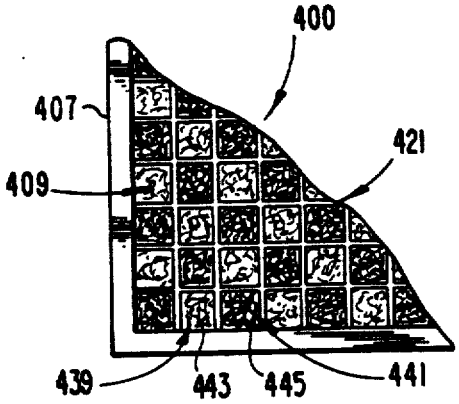
FIG. 2B is a partial front side elevational view of an alternative embodiment of the present invention.
Figure 2D:
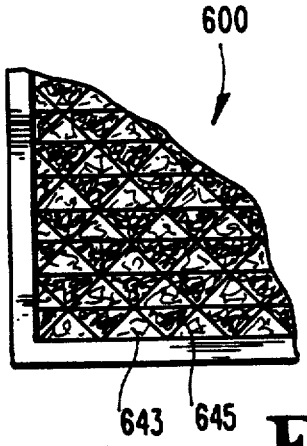
FIG. 2D is a partial front side elevational view of an alternative embodiment of the present invention.

Referring to FIG. 2B and to FIG. 2C, two alternate embodiments are shown in which two types of insulation material in the cells are intermingled across the partition area. In FIG. 2B, wall panel 400 is partially illustrated with frame 407 and acoustical core 409. Divider grid 421 is made up of a plurality of rectangular, square cells formed by vertical and horizontal divider walls intersecting at right angles. A checkerboard arrangement is provided in which a first type of insulation material 445 is contained in cell 441, and a second type of insulation material 443 is located in an adjacent cell 439. Insulation media 443 has a density less than the density of insulation media 445. For example, insulation media 443 may be two pound or three pound per cubic foot density fiberglass, whereas insulation media 445 may be six pound per cubic foot density. Accordingly, insulation media 443 and insulation media 445 have different sound absorption characteristics with different sound absorption values for various frequencies of sound energy. The two types of insulation media are intermingled across the partition area to distribute the two types of insulation media across the entire acoustical core 409. As illustrated, a checkerboard arrangement is used to achieve this, although other arrangements may be used which are random or patterned as long as there is an overall distribution of the two types of insulation media.

FIG. 2C shows a variation of the embodiment of FIG. 2B in which divider grid 521 of wall panel 500 is hexagonal in shape, forming a hexagonal honeycomb configuration in frame 507. Insulation media 543 has a density which is less than the density of insulation 545. Insulation media 543 is located in cell 539 which is adjacent to cell 541 containing insulation media 545. As with acoustical core 409, acoustical core 509 has two types of insulation media distributed across the partition area to absorb different frequencies of sound. Geometric configurations other than the rectangular or hexagonal configuration may be used, such as a triangular configuration (see FIG. 2D with wall panel 600 having a first type of insulation media 643 and a second type of insulation media 645) or a diamond shaped configuration (see FIG. 2E with wall panel 700 having a first type of insulation media 743 and a second type of insulation media 745). Also, the various insulation types may include different kinds of insulation. For example, insulation media 543 may be a fibrous batt material, whereas insulation material 545 may be loose, discrete particles of insulation.

Referring to FIG. 5, an exploded view of one embodiment of the present invention is shown. The method of fabricating a wall panel according to one embodiment of the present invention begins with locating divider grid 121 within frame 107 and rigidly connecting the two together by fasteners, glue, or other such means. Thereafter, a confinement layer such as screen mesh making up confinement layer 119 is adhered to the back side of frame 107 and of divider grid 121. The individuals cells are filled with insulation media 131 by inserting it individually into each cell such as by pouring discrete, loose particles of insulation therein, fitting pre-cut batts of fiber or pre-cut pieces of foam into the cells, or in-situ foaming in the cells. Confinement layer 113 is likewise fastened on the front side of frame 107 and divider grid 121 by heat sealing, glue, or other means. Thereafter, decorative covers such as decorative cover 111 and decorative cover 117 are applied to the exterior to provide an attractive appearance.

The method of fabrication of the embodiment shown in FIGS. 3B and 4B is similar except that rather than only one divider grid, such as divider grid 121, two divider grids **221*a* and 221*b* are used with septum 251 sandwiched therebetween. Furthermore, acoustic barrier panels, such as acoustic barrier panel 312 and acoustic barrier panel 320** may optionally be fastened to the frame in addition to or in lieu of the confinement layer prior to placing the decorative cover on the wall panel.

It is also contemplated that the divider grid 121 may be completed with the two confinement layers 113 and 119 and insulation media 131 prior to locating the divider grid 121 within frame 107. The process is to first provide the divider grid and fasten a confinement layer to one side of the grid. The compartments of the grid are filled with insulation material and thereafter the opposite side confinement layer is fastened to the grid. When this grid assembly is completed it is assembled to the frame.

Various sizes and shapes of wall panels may be used as is known in the partition art while falling within the spirit of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A movable prefabricated acoustical wall panel, comprising: a rigid frame defining a frame perimeter around a partition area; an acoustical core located in said partition area and supported by said frame, said acoustical core having a front side and a back side and comprising:

(a) a first divider grid formed by a network of intersecting divider walls, said divider walls defining a plurality of cells across said partition area along said front side;

(b) a second divider grid formed by a network of intersecting divider walls, said divider walls defining a plurality of cells across said partition wall along said back side;

(c) a substantially planar septum across said partition area and disposed between said first divider grid and said second divider grid, wherein said intersecting divider walls of said first divider grid run between said front side and said septum, and wherein said intersecting divider walls of said second divider grid run between said back side of said acoustical core and said septum;

(d) solid, low density insulation media in said cells of said first divider grid along said front side, wherein said insulation media along said front side is made of at least two distinct types of insulation having different densities intermingled across said first divider grid in adjacent cells to absorb different frequencies of sound;

(e) solid, low density insulation media in said cells of said second divider grid along said back side, wherein said insulation media along said back side is made of at least two distinct types of insulation having different densities intermingled across said second divider grid in adjacent cells to absorb different frequencies of sound;

(f) a first confinement layer across said first divider grid on said front side of said acoustical core to confine said insulation media in said first divider grid; and (g) a second confinement layer across said second divider grid on said back side of said acoustical core to confine said back insulation media in said second divider grid.

2. The wall panel of claim 1 wherein at least a portion of said insulation media in said first divider grid and of said insulation in said second divider grid comprises loose, discrete particles.

3. The wall panel of claim 2 wherein said first and second divider grids are rigid with said divider walls providing a cross-sectional moment of inertia to resist planar deflection of said acoustical core.

4. The wall panel of claim 3 and further comprising an acoustic barrier panel along said first confinement layer, said acoustic barrier panel comprising a rigid panel formed by materials selected from the group consisting of fiberglass, cellulose, urethane foam, polyethylene foam, fiberglass/chip laminate, fiberglass/chip composite, foam/chip laminate, and foam/chip composite.

5. The wall panel of claim 4 wherein said first confinement layer and said second confinement layer are made from a sheet of screen mesh material.

6. The wall panel of claim 5 and further comprising a first decorative cover sheet fastened to said frame along said first side, and a second decorative cover sheet fastened to said frame along said second side, wherein said first and second decorative covers cover said acoustical core within said frame.

7. The wall panel of claim 6 wherein said septum is made of a pliable, flexible sheet material.

8. The wall panel of claim 7 wherein said divider walls intersect at right angles to form rectangular cells in said divider grid.

9. The wall panel of claim 2 wherein said first confinement layer and said second confinement layer are made from a sheet of screen mesh material.

10. The wall panel of claim 1 wherein at least a portion of said insulation media in said first divider grid and of said insulation in said second divider grid comprises batts of fiberous material.

11. The wall panel of claim 1 wherein said first and second divider grids are rigid with said divider walls providing a cross-sectional moment of inertia to resist planar deflection of said acoustical core.

12. The wall panel of claim 1 wherein said first confinement layer and said second confinement layer are made from a sheet of screen mesh material.

13. The wall panel of claim 1 and further comprising a first decorative cover sheet fastened to said frame along said first side, and a second decorative cover sheet fastened to said frame along said second side, wherein said first and second decorative covers cover said acoustical core within said frame.

14. The wall panel of claim 1 wherein said divider walls intersect at right angles to form rectangular cells in said divider grid.

15. The wall panel of claim 1 wherein said divider walls intersect at angles to form hexagonal cells in said divider grid.

16. The wall panel of claim 1 wherein said divider walls intersect at angles to form triangular cells in said divider grid.

17. The wall panel of claim 1 wherein said densities of the insulation media contained in adjacent cells of said first and second divider grids on opposite sides of said septum are different from each other.

18. A moveable prefabricated acoustical wall panel, comprising:

a rigid frame defining a frame perimeter around a partition area;

an acoustical core located in said partition area and supported by said frame, said acoustical core having a front side and a back side and comprising:

(a) means for holding solid low density insulation media having a plurality of cells across said partition area between said front and back sides of said acoustical core;

(b) said insulation media comprises loose, discrete particles;

(c) a first confinement layer across said means for holding said insulation media on said first side of said acoustical core to confine said insulation media in said plurality of cells;

(d) a second confinement layer across said means for holding said insulation media on said second side of said acoustical core to confine said insulation media in said plurality of cells; and (e) a substantially planar septum across said partition area and disposed between and generally parallel to said first confinement layer and said second confinement layer, said insulation media being located both between said septum and said first confinement layer and between said septum and said second confinement layer, wherein said septum is made of a pliable, flexible, nonrigid sheet material.

19. The wall panel of claim 18 and further comprising an acoustic barrier panel along said first confinement layer, said acoustic barrier panel comprising a rigid panel formed by materials selected from the group consisting of fiberglass, cellulose, urethane foam, polyethylene foam, fiberglass/chip laminate, fiberglass/chip composite, foam/chip laminate, and foam/chip composite.

20. The wall panel of claim 18 wherein said first confinement layer and said second confinement layer are made from a sheet of screen mesh material.

21. A method of assembling a movable acoustical wall panel for attention of sound comprising the steps of:

providing a rigid frame defining a frame perimeter around a partition area and defining a front side and a back side;

mounting a preformed rigid divider grid in said partition area in said frame, said divider grid being formed by a network of intersecting divider walls, said divider walls defining a plurality of individual cells across said partition area, wherein said intersecting divider walls are positioned in said mounting step to run between said front and back sides of said acoustical core so that said cells are open along said front and back sides;

securing a first confinement layer across said divider grid on said first side to provide confinement for insulation media in said plurality of cells;

inserting solid, low density insulation media in said cells across said partition area, wherein said intserting step includes the steps of inserting a first type of insulation with a first density in a first subset of said plurality of cells, and inserting a second type of insulation with a second density less than said first density in a second subset of said plurality of cells to absorb different frequencies of sound, wherein said first and second subsets of cells are intermingled across said partition area to distribute said first and second types of insulation across said partition area, wherein cells containing said first type of insulation are adjacent to cells containing said second type of insulation across said partition area to absorb different frequencies of sound; and securing a second confinement layer across said divider grid on said second side to confine said insulation media in said plurality of cells.

22. The method of claim 21 and further comprising the step of securing an acoustic barrier panel along said first confinement layer, said acoustic barrier panel comprising a rigid panel.

23. The method of claim 22 and further comprising the step of securing a first decorative cover sheet to said frame along said first side.

24. The method of claim 21 and further comprising the step of securing a first decorative cover sheet to said frame along said first side.

25. A method of assembling a movable acoustical wall panel for attention of sound comprising the steps of:

providing a rigid frame defining a frame perimeter around a partition area and defining a front side and a back side;

providing a preformed rigid divider grid which is formed by a network of intersecting divider walls, said divider walls defining a plurality of individual cells which are open on the front and back sides of said divider grid;

securing a first confinement layer across said front side of said divider grid;

inserting insulation media into said individual cells of said divider grid, wherein said intserting step includes the steps of inserting a first type of insulation with a first density in a first subset of said plurality of cells, and inserting a second type of insulation with a second density less than said first density in a second subset of said plurality of cells to absorb different frequencies of sound, wherein said first and second subsets of cells are intermingled across said partition area to distribute said first and second types of insulation across said partition area, wherein cells containing said first type of insulation are adjacent to cells containing said second type of insulation across said partition area to absorb different frequencies of sound;

securing a second confinement layer across said back side of said divider grid; and mounting said divider grid with confinement layers attached and said insulation media installed in said partition area of said frame.

* * * * *

UNITED STATES PATENT AND TRADEMARK OFFICE

CERTIFICATE OF CORRECTION

PATENT NO. : 4,989,688

DATED : February 5, 1991

INVENTOR(S) : Thomas E. Nelson

It is certified that error appears in the above-identified patent and that said Letters Patent is hereby corrected as shown below:

At column 1, line 11, "commericial" should read --commercial--.

At column 3, line 3, "or" should read --of--.

Figure 2E:
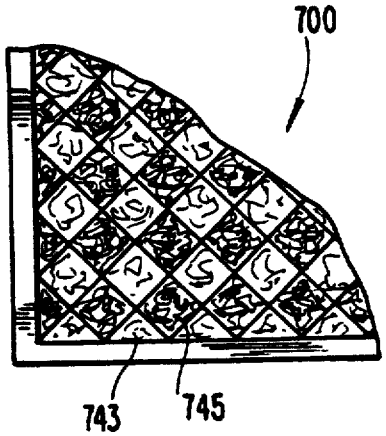

At column 3, line 44, "2E" should read --FIG. 2E--.

At column 4, line 42, "girl" should read --grid--.

At column 5, line 28, "medical" should read --medial--.

At column 5, line 48, "wall" should read --walls--.

At column 5, line 66, "FIGS." should read --FIG.--.

At column 6, line 16, "or" should read --of--.

At column 10, line 8, "attention" should read --attenuation--.

At column 10, line 26, "intsert-" should read --insert---.

At column 10, line 54, "attention" should read --attenuation--.

UNITED STATES PATENT AND TRADEMARK OFFICE

CERTIFICATE OF CORRECTION

PATENT NO. : 4,989,688

DATED : February 5, 1991

INVENTOR(S) : Thomas E. Nelson

It is certified that error appears in the above-identified patent and that said Letters Patent is hereby corrected as shown below:

At column 10, line 67, "intserting" should read --inserting--.

Signed and Sealed this

Twenty-third Day of June, 1992

*Attest:*

DOUGLAS B. COMER

*Attesting Officer*

*Acting Commissioner of Patents and Trademarks*